US008800167B2

(12) United States Patent
Doyle

(10) Patent No.: US 8,800,167 B2
(45) Date of Patent: Aug. 12, 2014

(54) PNEUMATIC INFLATING DEVICE CONTAINED ENTIRELY WITHIN SHOE SOLE

(76) Inventor: Harold S. Doyle, Schaumburg, IL (US)

( * ) Notice: Subject to any disclaimer, the term of this patent is extended or adjusted under 35 U.S.C. 154(b) by 620 days.

(21) Appl. No.: 12/884,132

(22) Filed: Sep. 16, 2010

(65) Prior Publication Data

US 2011/0067264 A1 Mar. 24, 2011

Related U.S. Application Data

(60) Provisional application No. 61/244,038, filed on Sep. 19, 2009.

(51) Int. Cl.

| | |
|---|---|
| ***A43B 13/20*** | (2006.01) |
| ***A43B 7/14*** | (2006.01) |
| ***A43B 7/20*** | (2006.01) |
| ***A61F 5/14*** | (2006.01) |

(52) U.S. Cl.

CPC ..... *A43B 13/20* (2013.01); *A43B 13/203* (2013.01)

USPC ..... 36/29; 36/88; 36/89; 36/93; 36/153; 36/154; 36/3 B; 36/35 B; 417/442; 417/435; 417/440; 417/313; 417/559; 417/279; 417/305

(58) Field of Classification Search

CPC ..... A43B 13/20; A43B 13/203

USPC ..... 36/29, 88, 89, 93, 153, 154, 3 B, 35 B; 417/442, 435, 440, 313, 374, 559, 279, 417/305

See application file for complete search history.

(56) References Cited

U.S. PATENT DOCUMENTS

| | | | | | |
|---|---|---|---|---|---|
| 1,976,656 | A * | 10/1934 | Clark | 36/153 |
| 4,420,893 | A * | 12/1983 | Stephan | 36/3 R |
| 4,446,634 | A * | 5/1984 | Johnson et al. | 36/29 |
| 4,995,173 | A * | 2/1991 | Spier | 36/29 |
| 5,222,312 | A * | 6/1993 | Doyle | 36/28 |
| 5,235,715 | A * | 8/1993 | Donzis | 12/142 R |
| 5,338,166 | A * | 8/1994 | Schultz | 417/442 |
| 5,353,525 | A * | 10/1994 | Grim | 36/88 |
| 5,727,338 | A * | 3/1998 | George et al. | 36/93 |
| 6,014,823 | A * | 1/2000 | Lakic | 36/93 |
| 6,305,102 | B1 * | 10/2001 | Doyle | 36/29 |
| 6,655,050 | B1 * | 12/2003 | Lowe | 36/93 |
| 6,725,573 | B2 * | 4/2004 | Doyle | 36/29 |
| 6,746,027 | B1 * | 6/2004 | Soo | 280/11.26 |
| 7,175,553 | B2 * | 2/2007 | Laliberty et al. | 473/593 |
| 7,395,615 | B2 * | 7/2008 | Lee | 36/29 |
| 8,250,782 | B2 * | 8/2012 | Callahan et al. | 36/29 |
| 2004/0049950 | A1 * | 3/2004 | Van Horne | 36/88 |
| 2004/0088882 | A1 * | 5/2004 | Buttigieg | 36/3 B |
| 2006/0196081 | A1 * | 9/2006 | Lee | 36/29 |
| 2007/0137065 | A1 * | 6/2007 | Vera | 36/29 |
| 2010/0247358 | A1 * | 9/2010 | Hermann | 417/471 |
| 2010/0329911 | A1 * | 12/2010 | Borst et al. | 417/559 |
| 2011/0131839 | A1 * | 6/2011 | Ballin et al. | 36/141 |

* cited by examiner

*Primary Examiner* — Clinton T Ostrup
*Assistant Examiner* — Cameron A Carter
(74) *Attorney, Agent, or Firm* — Carlos R. Villamar; The Villamar Firm PLLC

(57) ABSTRACT

A pneumatic inflation device disposed within the sole of a shoe and comprising a pump with integral air release valve and which is entirely within the sole, a pump actuator which is entirely within the sole when not in use, and an inflatable bladder which is entirely within the sole and is operatively connected to the pump. Such a device can include a mechanism to lock the pump actuator within the sole such that the mechanism's cap is flush with the outer wall of the sole and finger-operable to allow the shoe-wearer to easily operate the inflation device and release air therefrom.

10 Claims, 7 Drawing Sheets

PRIOR ART

FIG. 13A PRIOR ART
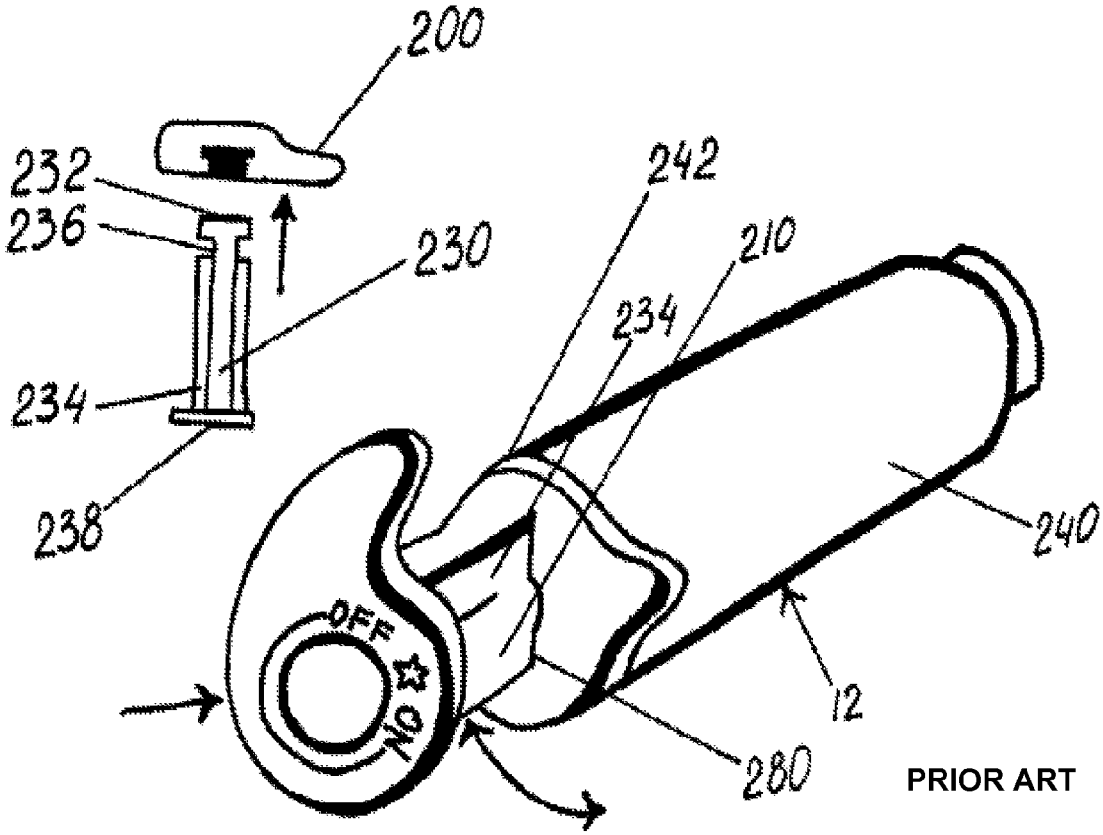
PRIOR ART
FIG. 13B
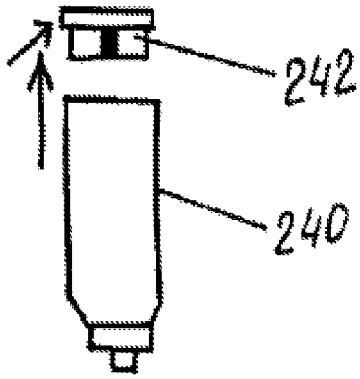
FIG. 13C PRIOR ART

PNEUMATIC INFLATING DEVICE CONTAINED ENTIRELY WITHIN SHOE SOLE

CROSS REFERENCE TO RELATED DOCUMENTS

The present invention claims benefit of priority to U.S. Provisional Patent Application Ser. No. 61/244,038 of DOYLE et al., entitled "PNEUMATIC INFLATING DEVICE CONTAINED ENTIRELY WITHIN SHOE SOLE," filed on Sep. 19, 2009, and is related to commonly-assigned U.S. Pat. Nos. 5,222,312; 6,305,102; and 6,725,573 of Harold S. DOYLE, the entire disclosures of which are hereby incorporated by reference herein.

BACKGROUND OF THE INVENTION

1. Field of the Invention

The present invention generally relates to shoes, and, more particularly, to pneumatic cushioning therein.

2. Discussion of the Background

Prior art shoes have involved a variety of inflation devices disposed at different locations. For instance, previous shoe arrangements have included soles that can be inflated at the arch to provide support. Other shoes contain soles which have sealed inflated chambers disposed within the soles in order to increase vertical bounce. These previous chambers are soft-sided bladders which distort into a more convex or spherical shape upon inflation. If the walls of the bladder are not constrained, for instance, by the structure of the sole of the shoe, the distortion occurs in every direction.

Others have addressed this problem by placing a foam core inside the bladder and adhering the entire surface of the interior bladder walls to the entire exterior surface of the foam core as is taught in U.S. Pat. No. 5,235,715 to Donzis. This arrangement of adhering all of the surface of the foam core limits the shape of the bladder to the shape of the foam core and does not allow for differential distortions of the bladder as the bladder is inflated. Such prior art shoes also have not allowed for selective adjustment of the pressure in the bladder chambers and may result in uneven air distribution in the sole of the shoe.

Pumps in prior art shoes have typically been either externally connectable to the shoe's air chambers or positioned in low stress areas on the upper portion of the shoe such as in the tongue or on the back of the heel. Such prior art shoes encounter different problems in use. For externally connectable pumps, the pump must be retrieved whenever inflation is desired. Pumps positioned on the upper portion add bulk to the shoe and limit agility. Such pumps also inhibit aesthetic choices in shoe design. Aesthetics may be particularly vital for golf shoes or non-athletic shoes.

In addition, the typical prior art shoe arrangements have either utilized pump actuators which were nonintegral with the shoe and required connection before inflation and disconnection before normal shoe use, or pump actuators which were connected to the external surface of the shoe, such as on the heel as in U.S. Pat. No. 5,222,312 to Doyle. Nonintegral pump actuators require that the shoe wearer retrieve the actuator every time inflation is needed. External pump actuators impose aesthetic limitations on footwear and add bulk to the "footprint" of the footwear.

Prior art shoes which have incorporated adjustable pneumatic cushioning have typically provided several air chambers in different areas of the sole which are interconnected via tubing. Eliminating the use of several distinct chambers would further reduce the weight of the shoe and simplify shoe construction. In addition, a complementary configuration between the pump, pump actuator, air release valve, and the air chamber or bladder could significantly reduce the bulk of the shoe.

It is, therefore, desirable to provide for improved pneumatic cushioning in footwear while including all necessary components for such cushioning within shoe and minimizing shoe bulk and aesthetic limitations. A shoe sole which addresses the problems of known footwear would be an important advance in the art.

SUMMARY OF THE INVENTION

Accordingly, a need addressed by the invention includes providing an improved pneumatic cushioning system entirely within the confines of a shoe sole.

Another need addressed by the invention includes providing a pneumatic inflation device with air release valve which is fully recessed in a shoe sole.

Another need addressed by the invention includes providing a pneumatic inflation device with a locking mechanism to secure the pump actuator entirely within the sole and flush with the sole's outer wall when not in use.

Another need addressed by the invention includes providing a locking mechanism which is easily finger-operated to facilitate inflation by a shoe wearer.

Another need addressed by the invention includes providing a recess for storing the pump actuator and air release valve to prevent damage thereto.

Another need addressed by the invention includes providing a pneumatic inflation device in which the bladder and pump are complementary configured so as to minimize shoe bulk.

Still another need addressed by the invention includes providing a pneumatic inflation device entirely within a shoe sole, in which the pump is positioned to avoid excessive stress.

Still another need addressed by the invention includes providing a pneumatic inflation device entirely within a shoe sole, which includes a pressure-release valve to permit adjustment of bladder pressure.

This invention is an improved device for providing pneumatic cushioning within a shoe sole. The invention represents a significant advance over the state of the art by providing a shoe sole which encompasses every necessary component for adjustable pneumatic cushioning.

The device includes a pump and air release valve which is entirely within the sole, a pump actuator which is entirely within the sole when not in use, and an inflatable bladder which is entirely within the sole and is operatively connected to the pump.

The inventive device can further include a locking mechanism which secures the pump actuator within the sole. It is preferred that the pump actuator can be locked only when the pump-actuator cap is flush with the outer wall of the sole. Such an arrangement facilitates use of the locking mechanism by the shoe wearer. The locking mechanism is finger-operated to further facilitate use by the shoe wearer.

The pump actuator preferably includes a piston rod having a distal end which is attached to the pump-actuator cap. The cap is rotatably movable between locked and unlocked positions only when the cap is flush with the sole. The cap is movable in this position due to the structure of the piston rod. The piston rod includes at least one radially extending portion which also extends axially from the piston towards the cap.

However, the radially extending portion does not reach the cap, rather, there exists a gap adjacent the cap.

The pump-cylinder top includes a slot which is sized to accept the piston rod and the radially extending portion. The piston rod can be moved in and out of the pump-cylinder freely. However, if the piston rod is inserted so that the radially extending portion moves completely past the pump-cylinder top, the rod can be rotated so that the radially extending portion is not positioned in-line with the slot. Thus, the pump actuator is locked in position within the pump cylinder.

The device is preferably positioned such that the pump is between the forefoot-pressure portion and the heel-pressure portion which strikes the ground first during walking or running by a typical shoe-wearer. This positioning prevents the pump from being damaged during the lifetime of the shoe.

The device is also preferably positioned such that the pump is oriented transverse to the longitudinal axis which passes from the heel to the toes. The device is more preferably oriented substantially perpendicular to that longitudinal axis.

The device is further preferably positioned in the midsole of the sole. The midsole being located between the outer sole which contacts external surfaces and the in sole which can typically be removed by the shoe-wearer.

The preferred bladder includes a bladder membrane which has an interior and exterior side, a foam core contained within the bladder and having a plurality of sides, and adhesive disposed on only one side of the foam core, and a portion of the interior side of the bladder membrane adhering to the adhesive.

The inflation device preferably further comprises an inlet conduit within the sole and connecting the pump to the bladder, a unidirectional flow valve between the inlet conduit and the bladder, a pressure-release valve within the sole and operatively connected to the bladder to permit the release of air from the bladder, and an exit conduit connecting the pressure-release valve to the bladder.

In order to minimize the bulk of the shoe, it is most preferred that the pump be positioned at least partially within the bladder. More preferably, the pump is positioned entirely within the bladder. In such a preferred embodiment, first and second inlet conduits have distal ends connected to the first and second bladders and proximal ends connected to a flow switching device, first and second unidirectional flow valves are disposed, respectively, within the first and second conduits and between the flow switching device and the first and second bladders, respectively, and first and second pressure release valves are operatively connected, respectively, to the first and second bladders.

The preferred device may also include a third bladder connected to the flow switching device by a third conduit; a third unidirectional flow valve between the flow switching device and the third bladder; and a third pressure release valve connected to the third bladder.

The invention also includes a pneumatically cushioned shoe having a sole and comprising a pump which is entirely within the sole, a pump actuator which is entirely within the sole when not in use, and an inflatable bladder which is entirely within the sole and is operatively connected to the pump. The pump actuator preferably includes a locking mechanism securing the pump actuator within the sole. The pump actuator more preferably includes a piston rod having a distal end with the locking mechanism including a finger-operated cap which is attached to the distal end. The cap is movable between locked and unlocked positions only when the cap is flush with the sole as discussed above.

Accordingly, in exemplary aspects of the present invention there is provided a pneumatically cushioned shoe having a sole including an integral outer wall for contact with external surfaces, the shoe including a pump with integral air release valve positioned within the sole; an inflatable bladder which is positioned within the sole and is operatively connected to the pump; and a pump actuator which is positioned within the sole when not in use, the pump actuator movable from a position beyond the outer wall of the sole to within the sole to pump fluid into the inflatable bladder.

In other exemplary aspects of the present invention there is provided an inflation device for a shoe, the inflation device including a sole, the sole defining an exterior surface and having an interior surrounded by the exterior surface, the interior including an inflatable bladder, the exterior surface including an exposed portion for contacting elements when being worn and a non-exposed portion covered by at least one other shoe component; and a pump with integral air release valve and having a pump actuator receivable within a pump cavity, the pump cavity positioned within the interior of the sole, the pump actuator movable from a position beyond the exposed portion of the sole to the interior of the sole to pump fluid into the inflatable bladder.

Still other aspects, features, and advantages of the present invention are readily apparent from the following detailed description, by illustrating a number of exemplary embodiments and implementations, including the best mode contemplated for carrying out the present invention. The present invention is also capable of other and different embodiments, and its several details can be modified in various respects, all without departing from the spirit and scope of the present invention. Accordingly, the drawings and descriptions are to be regarded as illustrative in nature, and not as restrictive.

BRIEF DESCRIPTION OF THE DRAWINGS

The embodiments of the present invention are illustrated by way of example, and not by way of limitation, in the figures of the accompanying drawings and in which like reference numerals refer to similar elements and in which:

FIG. 13A is a side view of the piston rod and cap disconnected;

FIG. 13B is a prospective view of the pump actuator and pump cylinder;

FIG. 13C is a side view of the pump cylinder and pump-cylinder top disconnected.

DETAILED DESCRIPTION OF THE PREFERRED EMBODIMENTS

Figure 1:
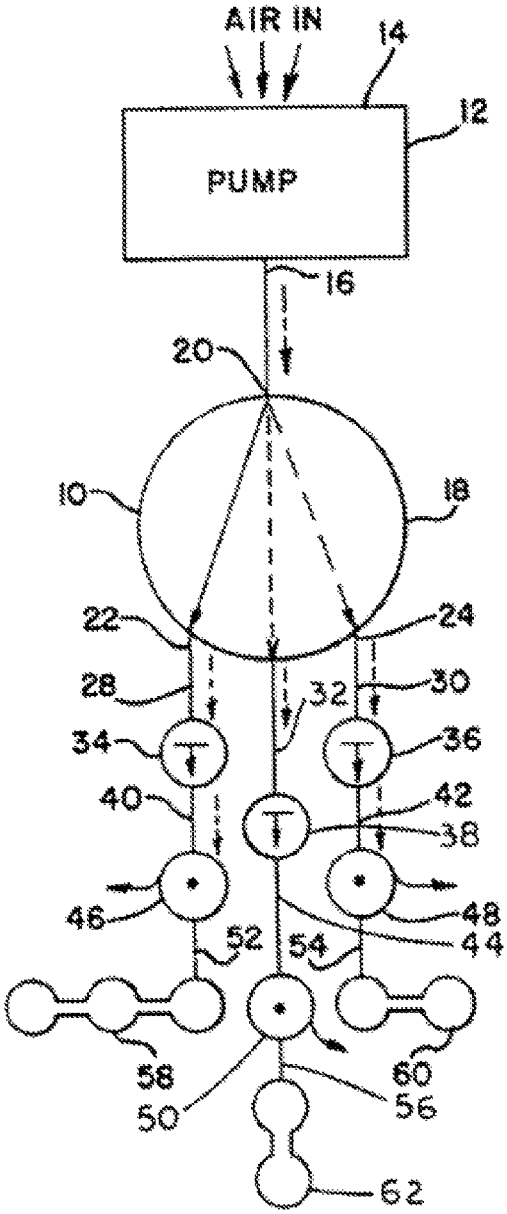
FIG. 1 PRIOR ART
FIG. 1 is a general schematic of the inflating arrangement utilized in the shoe.

Referring now to the drawings, wherein like reference numerals designate identical or corresponding parts throughout the several views, and more particularly to FIG. 1 thereof, there is illustrated The present invention is directed to a shoe with a pneumatic inflating device disposed therein. The general schematic of the shoe inflating arrangement is shown in FIG. 1 and includes three bladder sets. However, it will be apparent that the arrangement is adaptable to any plurality of bladder sets. The arrangement includes a pump 12 with an inlet 14 and an outlet 16. Outlet 16 is connected to a flow switching device 18 at a flow switching input 20. Flow switching device 18 operates as a selective valve which allows air flow into at least two outlets, the preferred embodiment having a first outlet 22, a second outlet 24, and a third outlet 26. Each outlet 22, 24, and 26 is connected to a corresponding conduit 28, 30, and 32. Each conduit 28, 30, and 32 is associated with corresponding unidirectional flow valves 34, 36, and 38. Each unidirectional flow valve 34, 36, and 38 is connected to corresponding conduit 40, 42, and 44. Each conduit 40, 42, and 44 is further associated with corresponding pressure release valves 46, 48, and 50. Conduits 52, 54, and 56 are connected to release valves 46, 48, and 50 and each conduit is connected to corresponding bladder sets 58, 60, and 62.

Figure 2:
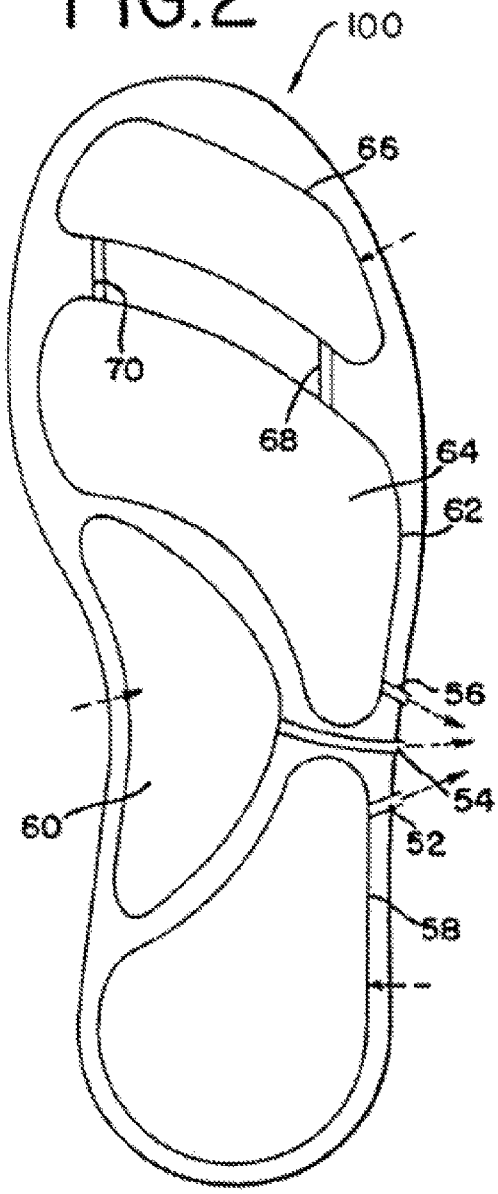
FIG. 2 PRIOR ART
FIG. 2 is a horizontal cross section of the shoe sole, revealing the inflation bladders and conduits.

FIG. 2 shows one arrangement of separate bladder sets 58, 60 and 62 in the sole of shoe 100 in which forefoot bladder 62 is comprised of mid-forefoot bladder 64 and toe forefoot bladder 66. Bladders 64 and 66 are interconnected by conduits 68 and 70. This multiple bladder configuration may also be implemented on the other bladder sets.

To pressurize the pneumatic system, the wearer preferably engages outlet 16 of pump 12 with switching input 20. Pump 12 is mounted on a base portion 74 in which inlet 14 comprises an orifice 76 having a unidirectional inlet valve 78. As the bellows 82 is lifted, the change in volume of air chamber 80 causes a corresponding reduction in pressure, thus causing air to flow through orifice 76 and valve 78 into chamber 80. Bellows 82 is operatively connected with cover 84 pivotally connected at hinge portion 86. Cover 84 is latchable to lock 88 through means of flange 90 engaging lock 88. Cover 84 is releasable through use of a semi-rigid material in its construction which will enable flexing and thereby cause disengagement of flange 90 from latch 88. The wearer then compresses bellows 82 which allows air flow into switching input 20. This in turn allows air to fill the selected bladder set via flow switching device 18 in which the wearer can selectively control the air input to bladder sets 58, 60, and 62. The wearer may also adjust the pressure in each bladder set via the respective pressure release valve.

Figure 3:
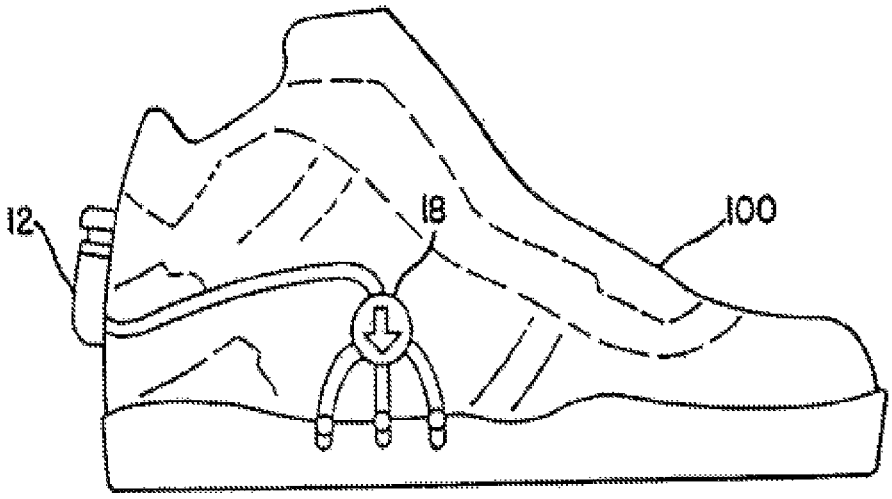
FIG.3 PRIOR ART
FIG. 3 is a side view of the shoe showing transparent conduits and the flow switching device.
Figure 4:
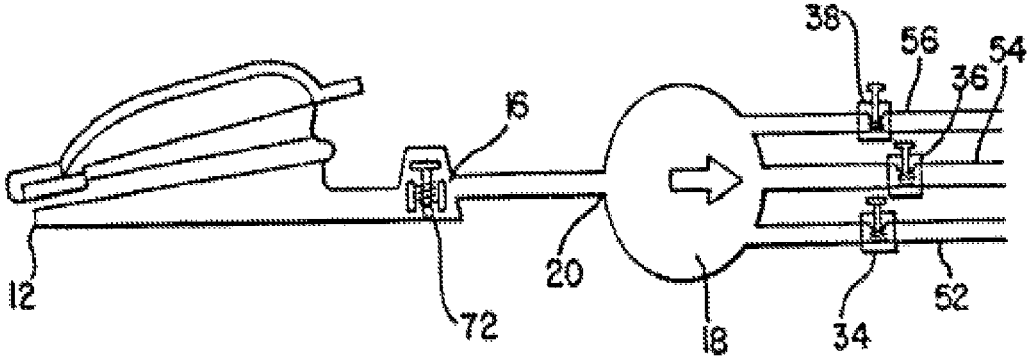
FIG.4 PRIOR ART
FIG. 4 shows a side bellows air pressurization unit coupled with an air release valve and a flow switching device.
Figure 5:
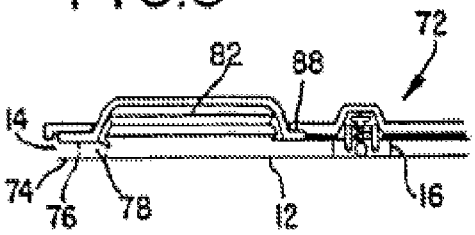
FIG.5 PRIOR ART
FIG. 5 shows the air pressurization unit in the closed position.
Figure 6:
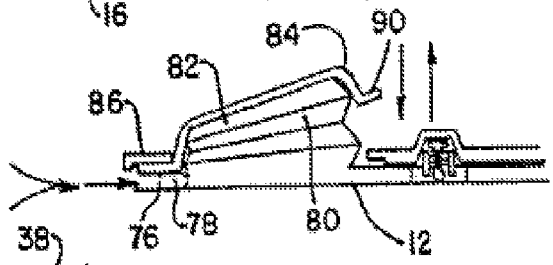
FIG.6 PRIOR ART
FIG. 6 shows the air pressurization unit in the open position.

The invention can be adapted to utilize a number of different combinations of elements to effectuate the goals of the invention. Thus, in FIG. 3, pump 12 could utilize an integral heel mounted plunger-type pump, as taught in U.S. Pat. No. 5,222,312, which is incorporated by reference herein. The plunger type pump could also be disposed in the sole of the shoe, or for that matter, located at any convenient place on the shoe. As an alternative to the plunger-type pump 12, the bellows-type pump of FIGS. 4, 5, and 6 could also be used.

Another variation is in the use, in the alternative, of different arrangements for flow switching device 18. A first embodiment could utilize a simple "lie" type flow switching device in which pressure at input 20 is applied equally at each of conduits 52, 54, and 56 applying equilibrium pressure at 20 using pump 12 and valves 34, 36, and 38 would result in equal pressurization of each bladder arrangement 58, 60, and 62. Customization of pressures could be accomplished by the simple expedient of bleeding off high pressure to reduce pressure in one or more of the selected bladder arrangements 58, 60, and 62. Well known valves of the Schrader type could be utilized with push button release or variations such as the Presta type which is effectively lockable for the tightening of a threaded collar on the valve needle.

Figure 7:
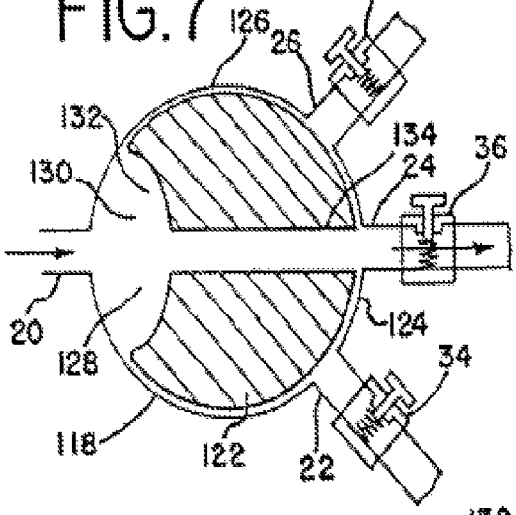
FIG. 7 is a sectional view of a switching input device.
Figure 8:
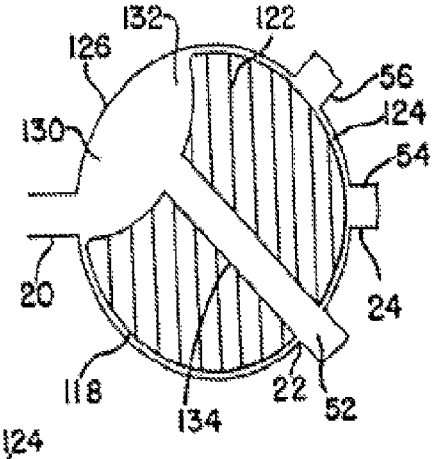
PRIOR ART FIG.8 PRIOR ART
FIG. 8 is a sectional view of the switching input device in a second position.
Figure 9:
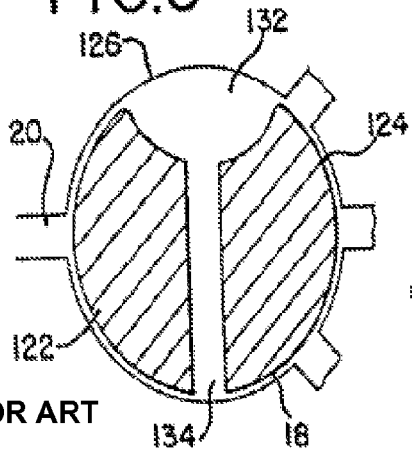
FIG. 9 is a sectional view of the switching device in a closed position.

A second alternative is to use a specially designed flow switching device having both flow directional control and valving control. Thus, switching device 118 in FIGS. 7, 8, and 9 uses rotor 122 contained within circumferential wall 124 of body 126 of device 118. Body 126 also has a floor 128 and a top (not shown) to completely define an enclosed plenum 130. Rotor 122 is sealed against wall 126 in such manner that rotor 122 may be turned in a plurality of positions. In FIG. 7, inlet chamber 132 is aligned with inlet 20 and in communication with passageway 134 that, in FIG. 7, further communicates to outlet 24. By comparison, in FIG. 8, rotor 122 has been turned so that conduit 134 is now in communication with outlet 22 while chamber 132 owing to its elongated configuration. In FIG. 9, rotor 122 has been further turned so that both chamber 132 and conduit 134 abut wall 126, thereby restricting passage of air between inlet 20 and any of outlets 22, 24, or 26. In like manner, of course, the rotor could be aligned with outlet 26 and inlet 20. It is also possible to adapt flow switching device 118 to a greater or lesser number of outlets, as desired. In the preferred embodiment, outlets 22, 24, and 26 would be associated with valves 34, 36, and 38, respectively. As described above, these could be of the Schrader or other improved Schrader types. Use of this approach in addition to the positional adjustment of rotor 122 to the closed position as shown in FIG. 9 would minimize pressure loss from bladders 58, 60, and 62.

Nevertheless, with the use of suitable sealing materials, and an integral pump, the user could dispense with all valves save the flow switching device 118. Use of a resilient, air impervious rotor 122 could provide self-sealing while appropriate coatings or seals, in the nature of gaskets or O-rings, could also be utilized.

An additional variation would be to use a separable pump. This would save the user the bulk of having an attached pump, further enabling the use of a larger capacity pump obviating bulk or weight concerns and enabling the use of higher strength or more economical materials than would be desirable with an integral, attached pump. Use of a separable pump would be more likely to take advantage of the use of a valve 72 associated with inlet 20, in the manner shown in FIG. 5.

Figure 10:
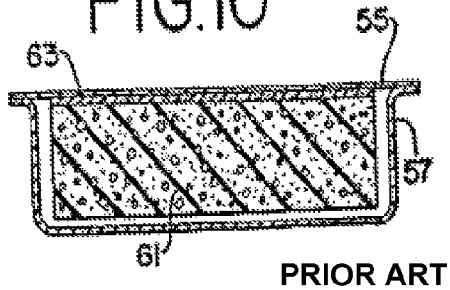
PRIOR ART FIG.10
FIG. 10 is a sectional view of a bladder with a foam core.

The bladders 58, 60, and 62 can be any plastic envelope. The bladder membranes forming the envelope are resistant to the passage of gas molecules but need not be totally impermeable. The gas within the bladder should not escape so rapidly that re-inflation of the bladder will be needed more often than every thirty minutes of use. The bladder may also contain a foam core 61 where the foam may be any foam such as ethyl vinyl acetate, polyurethane, a composite using these materials, or any other resilient sponge material known or that may become known in the footwear industry. One face of the foam core is secured to one interior wall or surface of the bladder. In the preferred embodiment shown in cross section in FIG. 10, the top surface of the foam core 61 is secured by an adhesive 63 to the interior surface of the top membrane 55 of the inflatable bladder 57. The adhesive 63 may be contact cement, heat activated cement, or solvent based cement. Alternatively, the bladder membrane may be attached to the foam core 61 by heat or radio welding.

Alternative embodiments are the attachment of the bladder membrane to the sides of the foam core or attachment of the lower membrane in the lower surface of the foam element.

FIGS. 11, 12A and 12B, and 13A, 13B and 13C depict the preferred inflation device disposed completely within the shoe sole.

Figure 11:
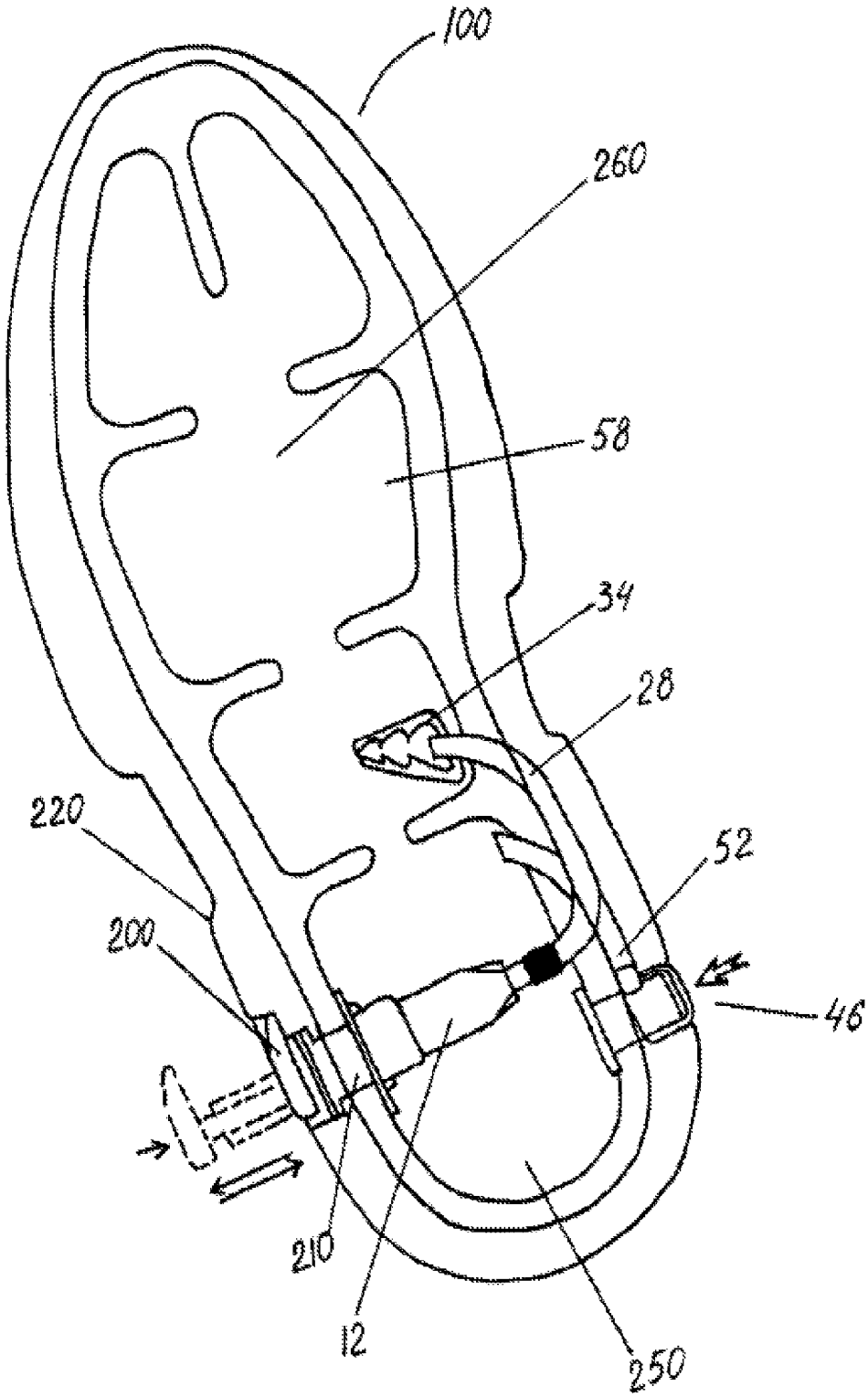
FIG. 11 PRIOR ART
FIG. 11 is a horizontal cross section of the shoe sole, revealing the inflation bladder and conduits.

FIG. 11 is a horizontal cross section of the shoe sole, revealing the inflation bladder and conduits. The embodiment shown includes only one inflatable bladder 58.

Pump 12 is received within the recess occupied by bladder 58 so that the space necessary for pump 12 is minimized Pump 12 is positioned substantially perpendicular to the axis passing from the heel to the toes. Pump 12 is positioned between heel-pressure portion 250 and forefoot-pressure portion 260 so that pump 12 is not damaged through normal shoe use.

Figure 12B:
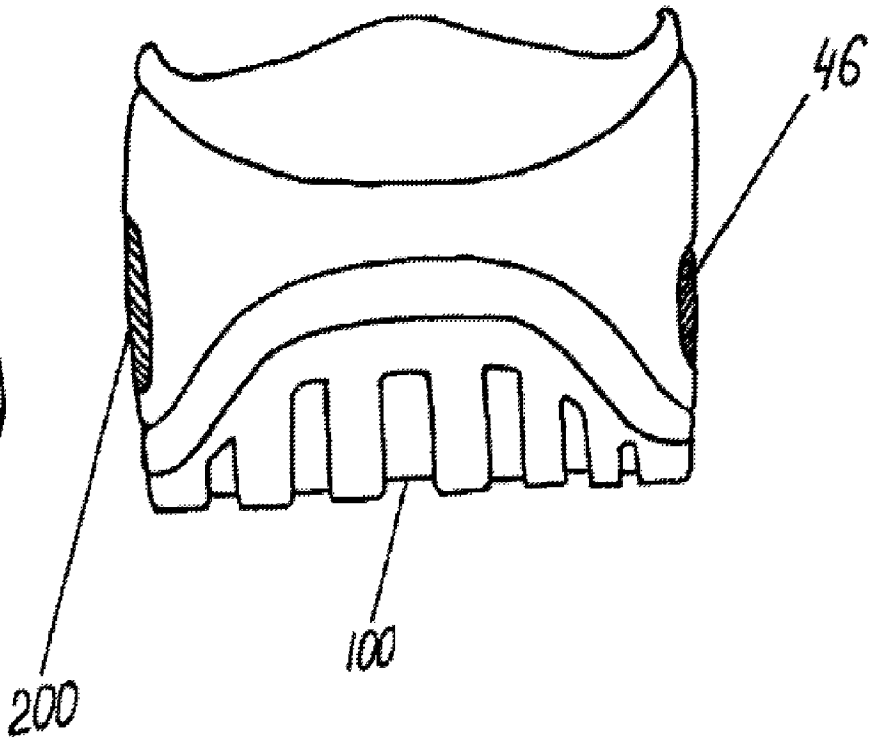
FIG. 12B PRIOR ART
FIG. 12B is a prospective view of the back of the inventive shoe.
Figure 12A:
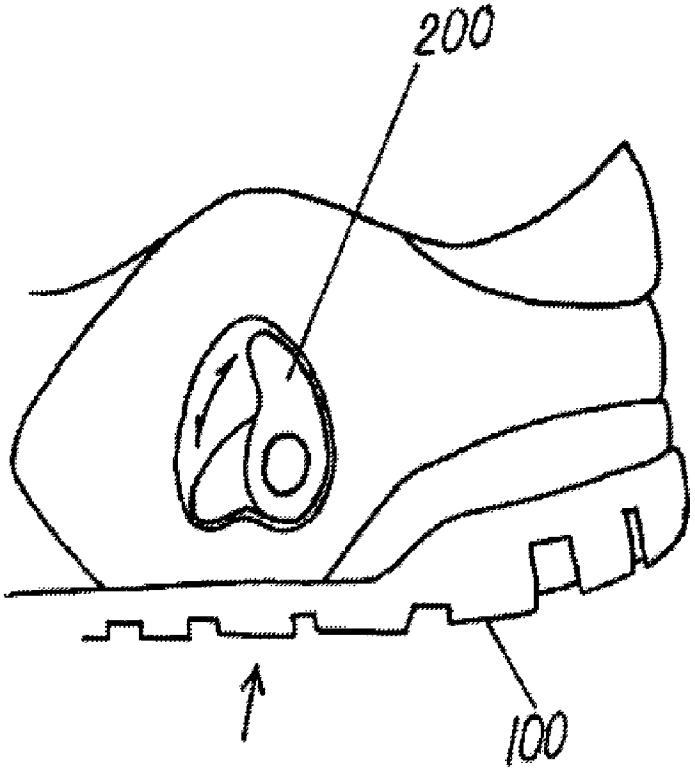
FIG. 12A PRIOR ART
FIG. 12A is prospective view of a side of the inventive shoe.

Pump actuator 210 is positioned within pump 12 (and is shown in phantom withdrawn from pump 12). Actuator 210 comprises a piston rod 230 with at least one radially extending side 234. Radially extending side 234 fits within slot 280 on cylinder top 242 so that piston rod 230 may be moved in and out of pump cylinder 240. Piston rod 230 includes gap 236 which is positioned between cap 200 and radially extending side 234. When pump actuator 210 is inserted completely within the shoe sole, slot 260 and gap 236 are juxtaposed, thus allowing pump actuator 210 to be rotated. When radially extending side 234 is moved to a position not in-line with gap 236, pump actuator 210 cannot be withdrawn from pump cylinder 240 and is locked in position. As shown in FIG. 12A, cap 200 can be moved in the direction of the arrows to either lock or unlock pump actuator 210. Cap 200 is flush with the outer wall 220 of the sole when pump actuator 210 is locked in position.

As shown in FIG. 13C, cylinder top 242 is removable from pump cylinder 240 to allow for the insertion of pump actuator 210 therein. Cylinder 242 is thereafter sufficiently secured to cylinder 240 to prevent non-intentional removal thereof.

FIG. 13A depicts cap 200 disengaged from distal end 232 of piston rod 230. In use cap 200 is sufficiently secured to rod 230 so that separation does not occur. Piston 238 is sized such that movement into cylinder 240 causes air to be force out of the pump chamber into the bladder.

Pump 12 is connected to bladder 58 via inlet conduit 28 and unidirectional valve 34. Unidirectional valve 34 prevents air from escaping bladder 58 back into inlet conduit 28. Bladder 58 is connected to pressure-release valve 46 via exit conduit 52.

Figure 14A:
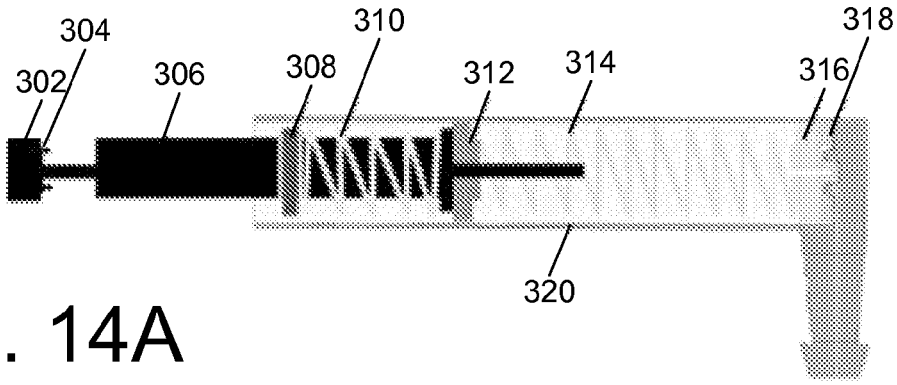
FIGS. 14A-14D are side views of an integrated air pump and air release valve that can be used with the embodiments of FIGS. 1-13.

FIGS. 14A-14D are side views of an integrated air pump and air release valve that can be used with the embodiments of FIGS. 1-13. In FIG. 14A, the integrated air pump and air release valve, include a piston heel 302, stopper(s) 304, a piston 306, a holder 308, a first spring 310, a first rubber gasket 312, a second spring 314, a second rubber gasket 316, an integrated check valve 318, and a cylindrical housing 320.

Figure 14B:
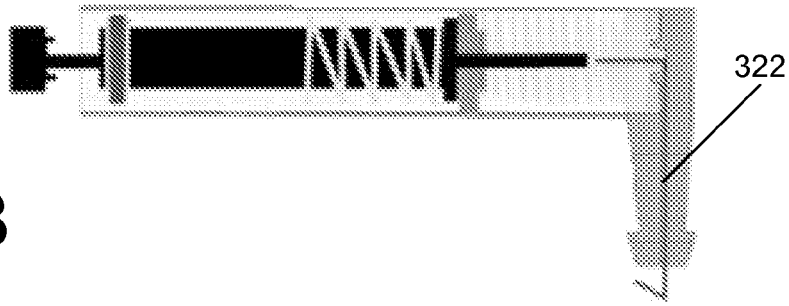
Figure 14C:
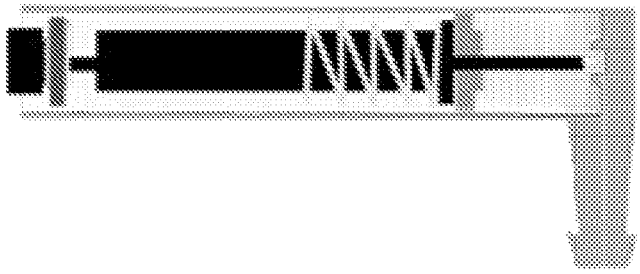
Figure 14D:
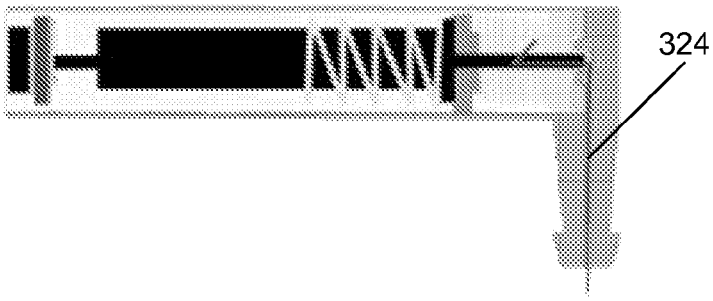

In FIG. 14A, the integrated air pump and air release valve is shown in the opened position, configured for starting the pumping of air into the system. In FIG. 14B, the integrated air pump and air release valve is shown in the pumping down stroke position, configured for pumping air into the system via the integrated check valve 318, as shown by arrow 322. In FIG. 14C, the integrated air pump and air release valve is shown in the locked position configured for maintaining air pumped into the system via the integrated check valve 318. In FIG. 14D, the integrated air pump and air release valve is shown in the air release position, configured for releasing air from the system via the integrated check valve 318, as shown by arrow 324. Advantageously, by integrating the air pump and the air release valve, as described with respect to FIGS. 14A-14D, the overall size of the system can be reduced.

Although the configuration depicting the inflating device being positioned entirely within the sole has only one set of bladder, inlet and exit conduit, and pressure-release valve, it is understood that such a inflating device could be used with each of the above-described configurations which utilize more than one such set.

Thus, it should be apparent that there has been provided, in accordance with the present invention, a shoe and inflation device for easily providing pneumatic cushioning in the shoe sole that fully satisfy the objectives and advantages set forth above.

While the present invention has been described in connection with a number of exemplary embodiments and implementations, the present invention is not so limited, but rather covers various modifications and equivalent arrangements, which fall within the purview of the appended claims.

What is claimed is:

1. A pneumatically cushioned shoe having a sole including an integral outer wall for contact with external surfaces, the shoe comprising:

a housing; a pump having an integral air release valve and included in the housing, wherein the housing is positioned within the sole; an inflatable bladder which is positioned within the sole and is operatively connected to the pump with the integral air release valve; and a pump actuator included in the pump with the integral air release valve and which is positioned within the sole when not in use, the pump actuator movable from a first position in a linear direction to pump fluid into the inflatable bladder and the pump actuator movable from a second position further in the same linear direction to release fluid from the inflatable bladder, wherein the sole includes a forefoot-pressure portion and a heel-pressure portion which strikes ground first during walking by a typical shoe-wearer and the pump is located at a location between the forefoot-pressure portion and heel-pressure portion, and the sole defines a longitudinal axis and the pump is oriented perpendicular to the longitudinal axis.

2. The shoe of claim 1 wherein the pump actuator includes a locking mechanism securing the pump actuator within the sole.

3. The shoe of claim 2 wherein:

the pump includes a piston rod having a distal end, and the locking mechanism includes a finger-operated cap which is attached to the distal end, the cap being movable between locked and unlocked positions only when the cap is flush with the outer wall of the sole.

4. An inflation device for a shoe, the inflation device comprising:

a sole, the sole defining an exterior surface and having an interior surrounded by the exterior surface, the interior including an inflatable bladder, the exterior surface including an exposed portion for contacting elements when being worn and a non-exposed portion covered by at least one other shoe component; and a housing; a pump having an integral air release valve and having a pump actuator receivable within a pump cavity and included in the housing, wherein the housing is positioned within the interior of the sole, the pump actuator movable from a first position in a linear direction to pump fluid into the inflatable bladder and the pump actuator movable from a second position further in the same linear direction to release fluid from the inflatable bladder, wherein the sole includes a forefoot-pressure portion and a heel-pressure portion which strikes ground first during walking by a typical shoe-wearer and the pump is located at a location between the forefoot-pressure portion and heel-pressure portion, and the sole defines a longitudinal axis and the pump is oriented perpendicular to the longitudinal axis.

5. The inflation device of claim 4 wherein the pump actuator includes a cap which is flush with the exposed portion when the pump actuator is secured within the sole.

6. The inflation device of claim 5 further comprising a locking mechanism securing the pump actuator within the sole.

7. The inflation device of claim 6 wherein:

the pump actuator includes a piston rod having a distal end, and the locking mechanism includes the finger-operated cap which is attached to the distal end, the cap being movable between locked and unlocked positions only when the cap is flush with the exposed portion of the sole.

8. The inflating device of claim 4 wherein the bladder includes:

a bladder membrane having an interior side and an exterior side;

a foam core contained within the bladder, said foam core having a plurality of sides; an adhesive disposed on only one side of the foam core; and whereby a portion of the interior side of the bladder membrane adheres to the adhesive.

9. The inflation device of claim 4 wherein the pump is positioned at least partially within the bladder.

10. The inflation device of claim 4 wherein the bladder comprises first and second bladders in the interior of the sole, the bladders being operatively connected to the pump.

* * * * *